US006123287A

United States Patent [19]

Bozeman et al.

[11] Patent Number: 6,123,287

[45] Date of Patent: Sep. 26, 2000

[54] MISSILE TRACKING SYSTEM HAVING NONLINEAR TRACKING COORDINATES

[75] Inventors: John W. Bozeman; Robert Zwirn, both of Los Angeles, Calif.

[73] Assignee: Raytheon Company, Lexington, Mass.

[21] Appl. No.: 06/263,827

[22] Filed: May 15, 1981

[51] Int. Cl.[7] ..... F41G 7/12

[52] U.S. Cl. ..... 244/3.11; 244/3.16; 250/203.1; 250/338.1; 250/203.6

[58] Field of Search ..... 244/3.11, 3.12, 244/3.13, 3.14

[56] References Cited

U.S. PATENT DOCUMENTS

| | | | |
|---|---|---|---|
| 2,930,894 | 3/1960 | Bozeman | 244/3.11 |
| 3,820,742 | 6/1974 | Watkins | 244/3.11 |
| 3,974,383 | 8/1976 | Chapman | 244/3.11 |
| 4,038,547 | 7/1977 | Hoesterey | 244/3.11 |

*Primary Examiner*—Charles T. Jordan
*Assistant Examiner*—Denise J Buckley
*Attorney, Agent, or Firm*—Colin M. Raufer; Leonard A. Alkov; Glenn H. Lenzen, Jr.

[57] ABSTRACT

A simplified missile tracker system that utilizes a single field of view while maintaining both the high resolution required for tracking and the wide field of view required for missile acquisition. The detectors in the acquisition portion of the field of view are clustered or ORed together to provide missile high signals of a weighted command for guiding the missile in elevation while greatly decreasing the required amount of detector signal processing. The bottom group of detectors are not clustered and they provide the high resolution and linear correction required for the accurate tracking of the missile in elevation. The azimuth tracking is provided by a synchronizing system and may be linear or nonlinear depending on the missile requirements.

10 Claims, 5 Drawing Sheets

Fig. 7.
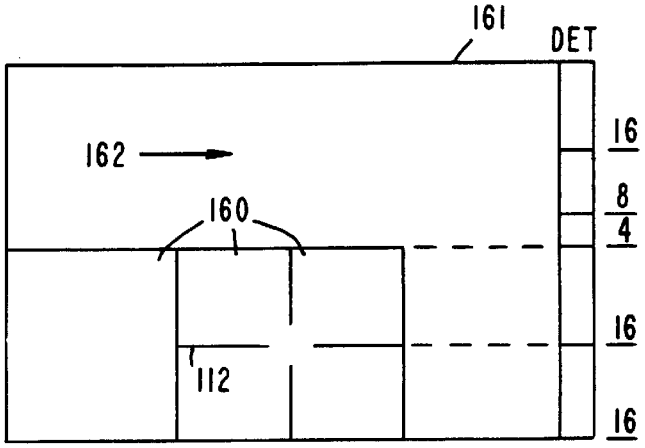
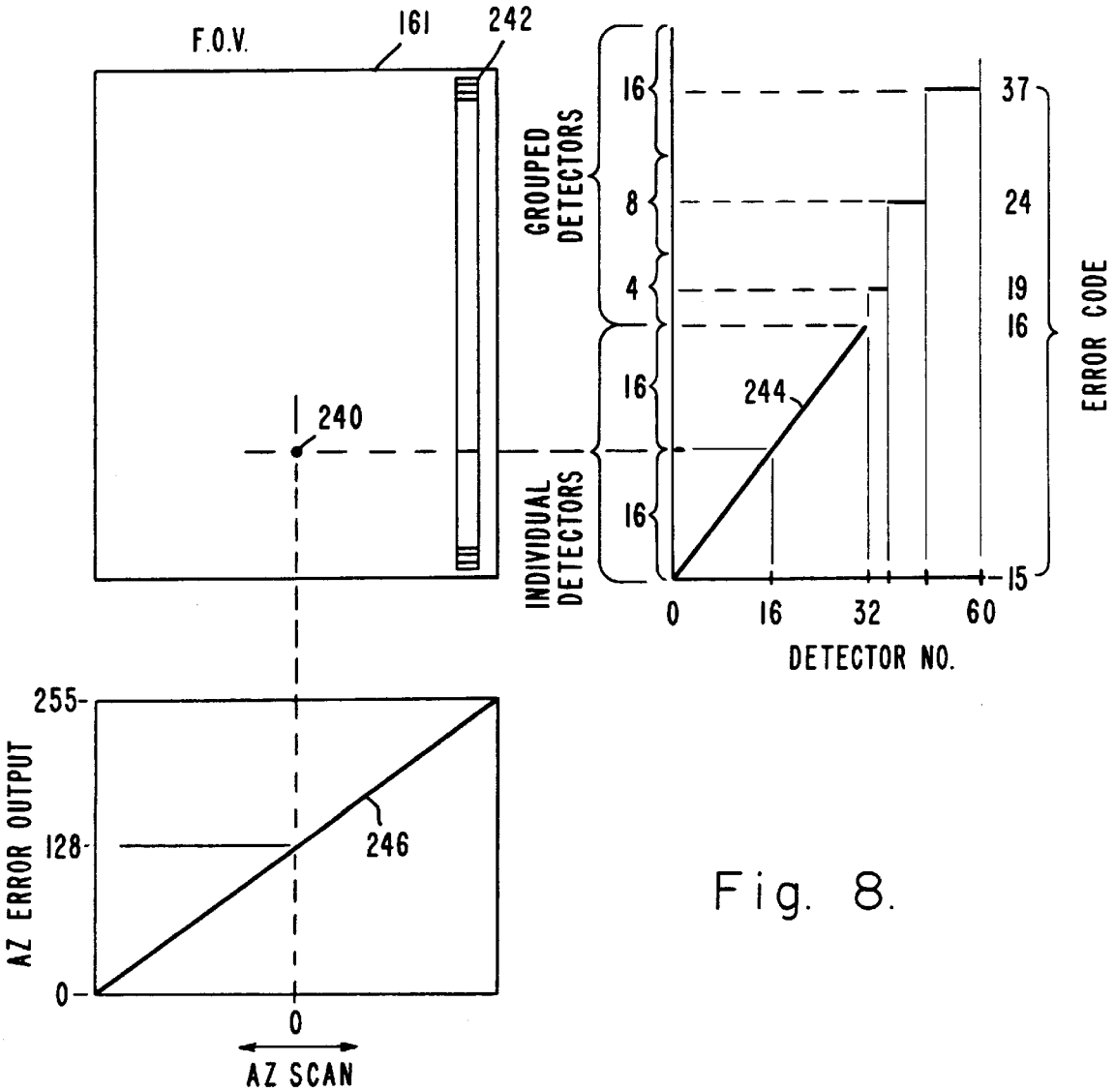
Fig. 8.

MISSILE TRACKING SYSTEM HAVING NONLINEAR TRACKING COORDINATES

TECHNICAL FIELD

This invention relates to missile control systems and particularly to a missile tracking system having improved infrared processing to provide a single field of view that has both high resolution for tracking and has a wide field for acquisition.

BACKGROUND OF THE INVENTION

1. Field of the Invention

In missile tracker systems, the operator views the target in the visible spectrum while the tracker portion of the system tracks the missile in the shorter wavelength of the infrared. The tracker system utilizes a forward looking infrared tracker which tracks a distinctive IR beacon or other source of energy mounted on the tail of the missile while the operator sights a reticle in the field of view on the target through a separate sighting arrangement. Error signals are then generated and transmitted to the missile such as through a wire or through space and the missile is guided onto the target such as a ground target. The tracker receives scanned scene information from a line or column of detectors which effectively horizontally scans the field of view or scene by a scanning mirror, and produce signals which represent the scene imagery. The display to the operator is then formed by a column of light emitting diodes responding to the detector signals and being effectively scanned by the scene scanning mirror. Thus, the operator views the target through the same sensor that is utilized to automatically track the missile beacon.

2. Description of the Prior Art

In a typical IR missile tracker system, the infrared detector portion of the system may have a relatively wide field of view but the tracker portion of the system requires that an excessively large number of detectors be used in the detector portion and relatively complex processing be used in the tracker portion in order to provide a high resolution over the entire field of view. Thus, conventional systems utilize a wide field of view mode for acquisition of the missile with a low resolution and a narrow field of view mode for tracking of the missle. A two field of view system has the disadvantages that only one field can be viewed at a time and that the dead time when switching fields of view is undesirble. A system that utilizes a minimum number of detectors and processinng and that provides a single field of view having both wide field of view characteristics for acquisition and high resolution characteristics for tracking would be a substantial advance in the art.

SUMMARY OF THE INVENTION

It is therefore an advantage of the invention to provide a tracker operating with a single field of view while having a high resolution for tracking.

It is a further advantage of the invention to provide a single field of view tracking system that has both a wide field for acquisition and a high resolution field for tracking.

It is a still further advantage of the invention to provide a missile tracker utilizing infrared detectors and in which the multiplexing and processinng functions are greatly simplified.

It is another advantage of the invention to provide a missile tracker having a nonlinear coordinate system so that weighted commands rapidly guide the missile to its required path.

It is still another advantage of the invention to provide a missile tracker system in which the operator views a high resolution scene through the same sensor as the tracker and the tracker provides high resolution tracking with a reduced number of channels to be processed.

The missile tracking system in accordance with the invention includes an infrared detector system, a missile tracker and an operator sighting system, with both the tracker and the sighting system operating through the same infrared detector system. The tracker tracks a beacon on the tail of the missile and the operator sights onto the target toward which the missile is guided. The infrared detector system includes a scan mirror which scans the scene in azimuth and transfers the scene to a single line of detectors such as 60 in the illustrated system. The outputs of the detectors are clustered or combined by "OR" gates in certain portions of the single field of view prior to multiplexing. The clustering is selected as a function of the missile path during acquisition and the position of the high resolution or tracking portion of the field of view which is utilized after the missile is acquired and guided into the tracking portion. In one arrangement in accordance with the invention, the outputs of a number of detectors at the top of the field of view are combined into a minimum number of channels as the missile is viewed in the top of the field of view during the acquisition phase after launching. The outputs of the detectors at the bottom of the field of view where high tracking resolution is required are not clustered or combined so that the missile can be accurately and linearly guided when it is near the target. Thus, the tracker provides both a wide field of view and a high resolution for fine tracking while greatly reducing the channels to be processed. Further, the channels connected to the clustered detectors provide nonlinear error signals to rapidly bring the missile into the tracking phase.

BRIEF DESCRIPTION OF THE DRAWINGS

The novel features that are considered characteristic of this invention are set forth with particularity in the appended claims. The invention itself, both as to its organization and method of operation as well as additional objects and advantages thereof, will best be understood from the following description when read in connection with the accompanying drawings in which like reference numbers refer to like parts and in which:

FIG. 7 is a schematic diagram of the scanned field of view for further explaining the operation of the system in accordance with the invention; and FIG. 8 is a schematic diagram illustrating the single field of view utilized by the system of the invention, the azimuth error output signals and the nonlinear elevation tracking error output signal.

DETAILED DESCRIPTION OF THE INVENTION

Figure 1:
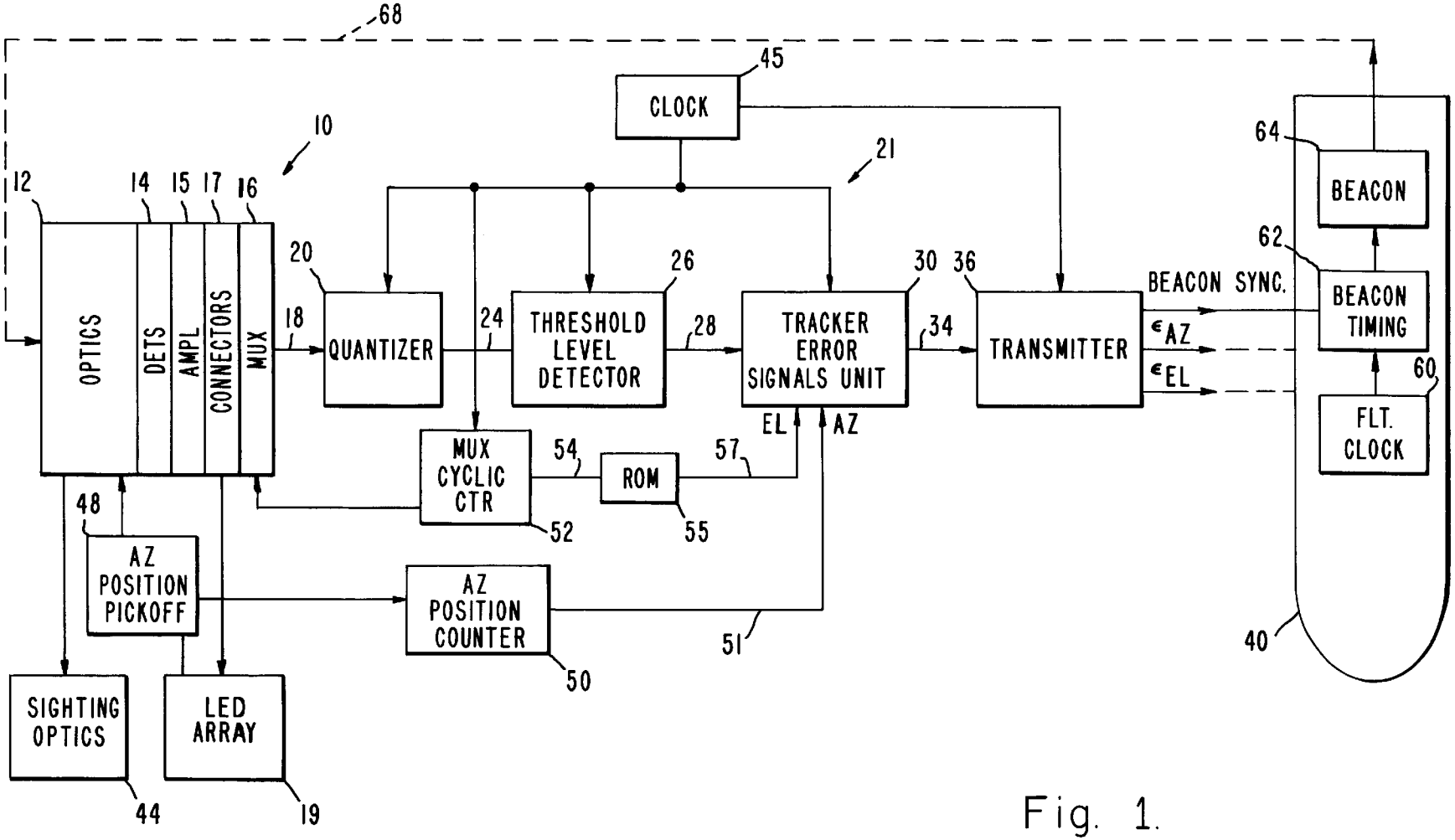
FIG. 1 is a schematic block diagram showing the missile tracker system and the missile that is tracked and guided, for explaining the system in accordance with the invention.

Referring first to the overall system diagram of FIG. 1, the missile tracking system in accordance with the principle of the invention utilizes a forward looking infrared system 10 including an optics unit 12, a row of detectors 14 and an amplifier unit 15. The output of the amplifier unit 15 is applied to a connector unit 17 and in turn to both a multiplexer unit 16 of a tracker 21 and to an LED (light emitting diode) unit 19. The multiplexer unit 16 contains the clustering feature in accordance with the invention. The multiplexed detector signals are applied from the multiplexer 16 through a lead 18 to a quantizer 20 and in turn through a composite lead 24 to a threshold level detector 26. A threshold is set in the threshold level detector 26 so as to detect only the relatively high amplitude signals provided by the missile beacon energy of the series of detector 14 output signals representing a frame of the total field of view. The output signals from the threshold level detector 26 are applied through a composite lead 28 to a tracker error signal unit 30 which develops error signals $\epsilon_{AZ}$ and $\epsilon_{EL}$ on a composite lead 34. The error signals are applied through a composite lead 34 to a transmitter unit 36 which transmits these signals in a suitable manner through space or through a control wire to a missile 40. A suitable clock and timing unit 45 applies clock and timing signals to the quantizer 20, the threshold level detector 26, the tracker unit 30, the transmitter 36 and a multiplex cyclic counter 52.

A sighting optics unit 44 is provided to cooperate with the optics unit 12 and the LED array 19 which is optically coupled to the optics unit 12 for providing the scene or field of view to the operator. An azimuth position pickoff unit 48 is positioned to receive light from a constantly glowing LED adjacent to the LED array 19 to provide azimuth reference pulses. An azimuth position counter 50 is coupled to the azimuth position pickoff unit 48 and is coupled through a lead 51 to the tracker unit 30. The multiplex cyclic counter 52 applies multiplex control signals to the multiplex unit 16 and applies the control signals through a lead 54 to a look-up ROM (read only memory) 55 which in turn applies a weighted elevation error code to the tracker unit 30 representing the elevation error signals. The multiplexer unit 16, the quantizer 20, the threshold level detector 26, the tracker unit 30, the counters 50 and 52, and the ROM 55 may be considered as the tracker 21 portion of the system.

The missile 40 includes a flight clock 60 which applies clock signals to a beacon timer 62 also receiving beacon sync signals from the transmitter 36. A beacon 64 which may be any suitable IR energy emitting arrangement, is responsive to the beacon timer 62 to transmit IR energy through a path in space indicated by a dotted line 68, to the optics unit 12.

Figure 2:
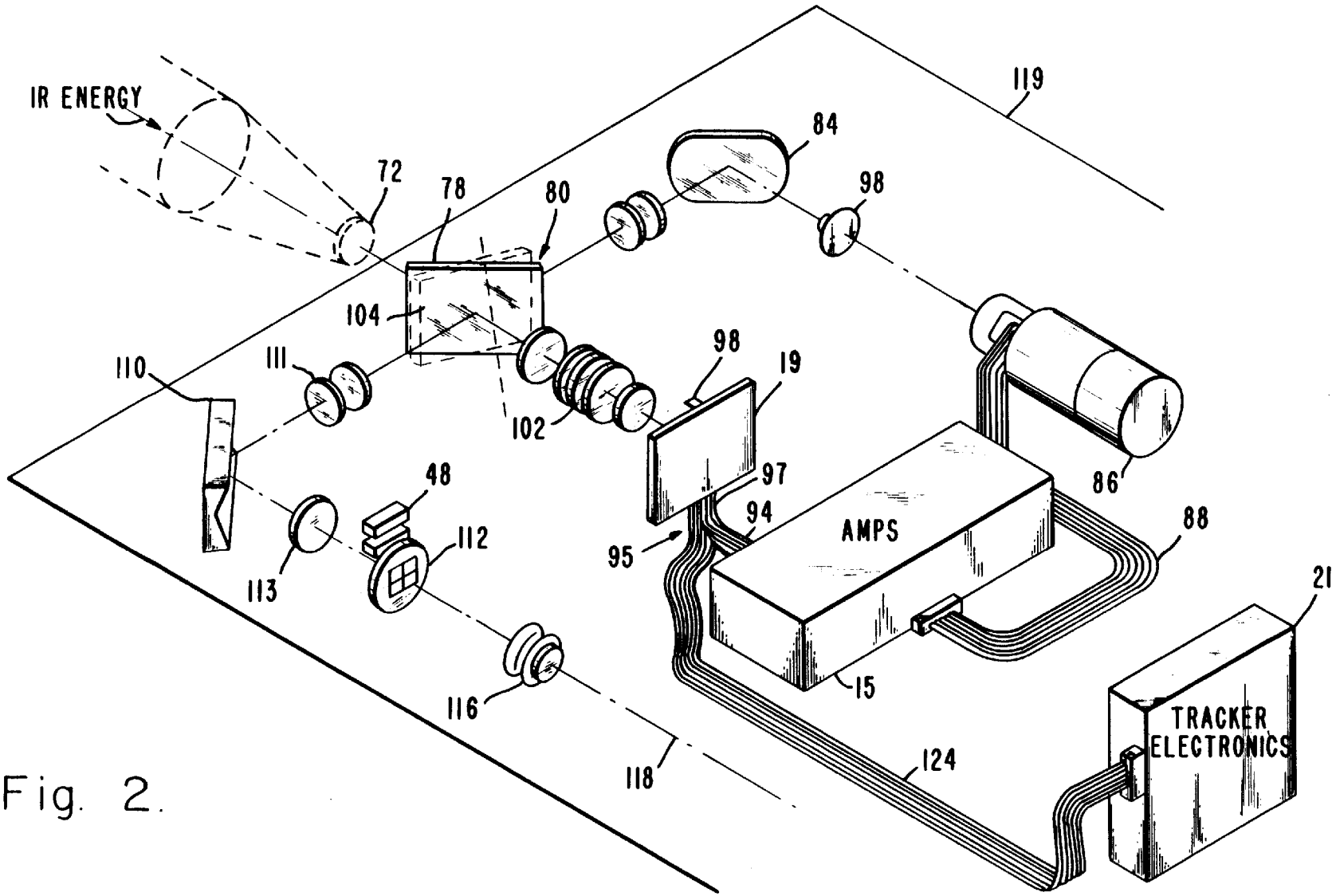
FIG. 2 is a schematic perspective view of the missile tracker system including the infrared detector system, the sighting system and the tracker.

Referring now to FIG. 2 for further explaining the system operation, the IR energy is received from the field of view by a suitable lens 72. It is to be noted that one of the features of the invention is that the tracker system operates with a single field of view. The energy is applied to a first side 78 of an azimuth scanning mirror 80 and is reflected through suitable optics to a reflector 84 which reflects the energy into a window (not shown) of a detector and dewar cooling unit 86. The single vertical row 14 of scene responsive detectors, being 60 detectors in the illustrated system, is included in the unit 86. The detector output signals are applied through a composite lead 88 to the amplifier unit 15 which includes suitable amplifiers for each detector output lead. The amplified signals are applied through a composite lead 94, through a connector assembly 95 and through a composite lead 97 to the light emitting diode array 19 which includes a single vertical row of light emitting diodes. The synchronizing LED 98 is positioned on top of the LED array 19 for providing a continuous source of energy for the azimuth reference pulses. The energy provided by the vertical line of light emitting diodes, which includes 60 LEDs in the illustrated system, is applied through a lens system 102 which may include suitable collimator lenses and a phase shift lens, to a back surface 104 of the scanning mirror 80. The energy from the scanned LED array 19 is then reflected through suitable focusing objective lenses 111 to a roof mirror 110 and in turn through other suitable lens units 113 to a reticle unit 112. The constant energy from the azimuth sync source 98 is also scanned by the mirror surface 104 and received by the azmimuth position pickoff unit 48. From the reticle 112, the scene representing energy from the light emitting diodes is applied to an eyepiece 116 along a line of sight 118. Thus, the operator views the entire field of view as the LED array 19 is scanned by the scan mirror 80.

Figure 3:
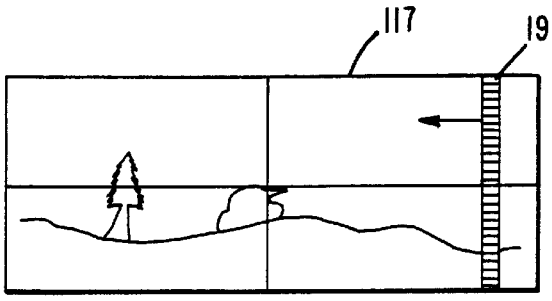
FIG. 3 is a schematic diagram for explaining the operation of the light emitting diode array being effectively scanned in azimuth to provide the sight display to the operator.

Referring temporarily to FIG. 3, generation of the rectangular display for the operator is accomplished in conjugate to the scene image scan. The scan mirror 80 acts both as the scan mirror for the input energy and the scan mirror for the visible light emitting diodes (LED) output energy. Because the scan mirror 80 is a plane parallel double sided mirror, the scan angles are identical in magnitude for both the input energy and the LED energy, and as a result, an exact 1:1 correspondence exists between respective angular positions of the scan mirror. Thus, the image of the LED array 19, because of its reflection off of the scan mirror 80 is translated in azimuth resulting in an apparent side-to-side sweep of the vertically oriented LED array 19, which has a line of 60 light emitting diodes in the illustrated system. Thus the display 117, for view by the operator as a result of the retentivity of the human eye, is generated by the apparent sweep across the azimuth field of view of the stationary LED array 19.

Referring back to FIG. 2, the 60 amplified detector signals are applied from the connector assembly 95 through a composite lead 124 to the tracker electronics unit 21 which includes the multiplexer unit 16 as well as the other tracker elements for developing the azimuth and elevation error signals. Three lines 119 represent that the basic sight assembly is movable by the operator so that the reticle of the reticle unit 112 can be maintained pointed at the target while the missile is being tracked and guided.

Figure 4:
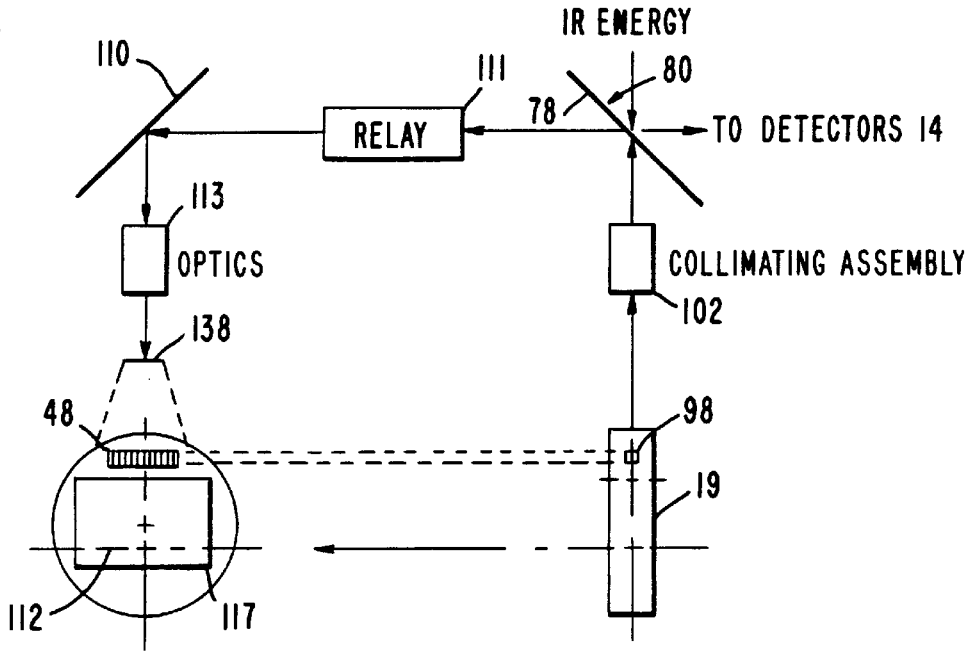
FIG. 4 is a schematic diagram for further explaining the azimuth optical pickoff arrangement utilized in the system of the invention.
Figure 5:
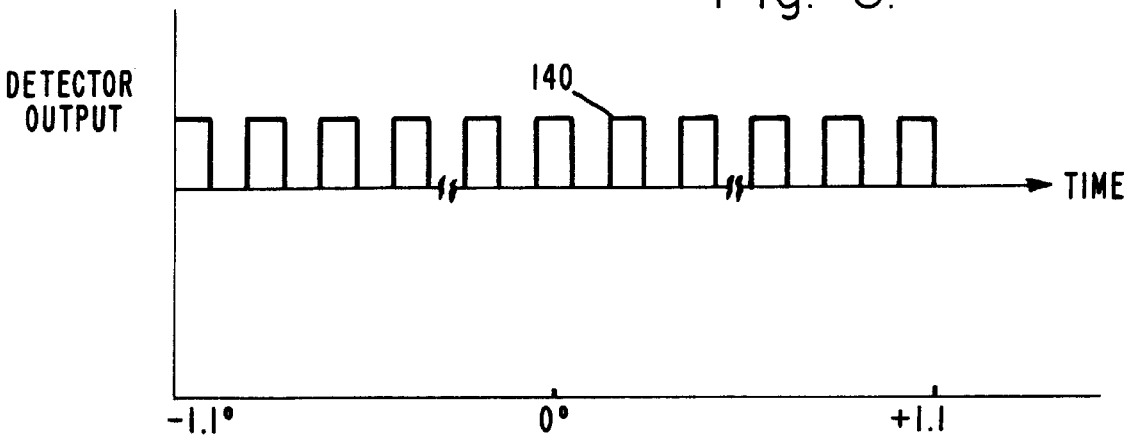
FIG. 5 is a schematic diagram of waveforms showing amplitude as a function of time for further explaining the generation of the azimuth reference pulses.

Referring now to FIG. 4 which is an azimuth optical pickoff functional diagram, the operation of the display will be explained in further detail. The IR energy received by the scanning mirror 80 is reflected to the detectors 14 which are utilized to control the LED array 19. As the mirror 80 scans in azimuth, the light passes from the LED array 19 through the optical collimating assembly 102 along with continuous light from the synchronizing source 98 which is positioned so that its light will reflect out of the display field of view 117. After reflection from the surface 104 of scan mirror 80, the light or energy passes through the lenses 111 and is reflected from the roof or folding mirror 110. The visible light then passes through the optics 113, to a reticle focal plane 138 at the eyepiece 116 (of FIG. 2) to provide the display field of view 117 showing a fixed reticle 112. The light from the synchronizing source 98 is swept across the azimuth synchronizing pickoff detector 48 which is a single detector block with a grating on the surface that is receiving the light to form a picket fence reticle. Thus, azimuth synchronizing pulses are formed during each complete azimuth scan of the scan mirror 80, the number of azimuth pulses being 256 for each scan of the mirror 80 in the illustrated system. The output pulses of the detector or pickoff detector 48 are shown in FIG. 5 by a pulse train 140 as the mirror 80 scans through an angle from −1.1° to +1.1°, for example. The picket fence reticle is registered at the time of assembly with the center of the field of view 117 which is the center of the reticle 112, so that 128 pulses of the pulse train 140 occur in azimuth before the reference (vertical line) and 128 pulses occur in azimuth after the reference. Thus, a precise azimuth reference is established from which the video tracker unit 21 (FIG. 2) can determine the missile position relative to the reference of the reticle 112.

Figure 6:
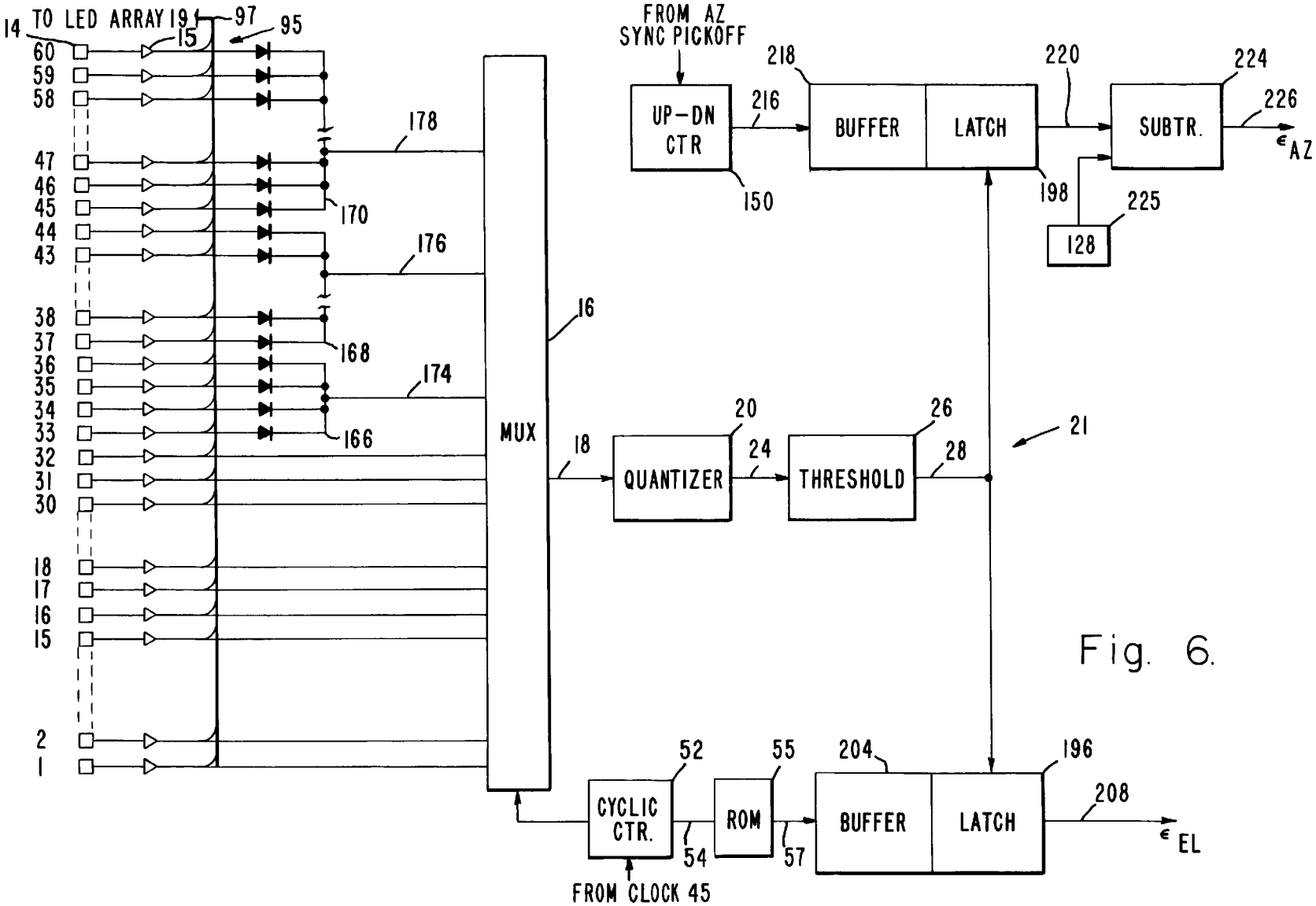
FIG. 6 is a schematic block and circuit diagram for explaining the clustering of the detector output signals and the formation of the nonlinear elevation tracking signals in accordance with the invention.

Referring now to FIG. 6 which allows the line of detectors 14 and the tracker 21 as well as to FIG. 7 which shows the relation of the detectors and the high resolution and low resolution portions of the single field of view, the clustering feature of the invention will be explained in further detail. The array or line of detectors 14 is divided into groups of detectors depending on the resolution desired for each portion of the scene. A high resolution portion 160 of a scene or field of view 161 is formed from detectors numbers 1–16 and the lower resolution portion 162 from detectors numbers 16–32, thus retaining the high resolution and linear characteristics of the missile tracker which processes the detected information. The high resolution portion 160 extends across the entire azimuth portion of the field of view 161 but only the enclosed portion provided by the reticle 112 is normally utilized for tracking. In the upper portion 162 of the detector field of view 161, the number of detector channels which must be processed are reduced to limit the amount of multiplexing and processing which must be performed in the tracker 21. The portion 162 of the field of view 117 provides a lower resolution to the display and to the tracker electronics but adequate resolution for missile acquisition such as during the initial launch period of the missile. Thus, the system provides a wide field of view consistent with the IR portion of the system and a high resolution in the field 160 of the field of view 161. Once acquired, the missile is guided in response to nonlinear coordinates so that the missile beacon moves and is retained in the high resolution portion 160 of the field of view 161. In the illustrated system, detectors numbers 33–36 are combined in an OR gate 166 having four diodes, detectors numbers 37–44 are combined in an OR gate 168 having eight diodes and detectors numbers 45–60 are combined in an OR gate 170 having 16 diodes. It is to be noted that the clustering is arranged so that the further up from the high resolution portion 160, the less the resolution, which is consistent, for example, of tracking a missile which is initially fired into the upper portion of the field of view and is easily acquired because of the brightness of the close beacon. The amplifiers which drive the diodes of the OR gates 166, 168 and 170 are near saturation so that the signal amplitude from the gates is relatively constant even when more than one detector is energized by the beacon such as when the missile is near to the tracker unit.

The three OR gates 166, 168 and 170 which combine the outputs from a plurality of detectors, apply signals through respective leads 174, 176 and 178 to the linear operating multiplexer 16 along with the 32 detector leads from the high resolution portion of the detector array 14. The 60 signals applied to the LED array 19 are derived from the detector output leads as shown by the composite lead 97 prior to their connections to the diode gates.

The tracker 21 responds to the detected signals on the lead 18 at the output of the multiplexer 16, which signals are applied through the quantizer 20 and the lead 24 to the threshold level detector 26. The multiplexer unit 16 responds to the cyclic counter 52 which sequentially provides 35 multiplexing control signals to the multiplexer unit 16 which in turn provides 35 sequential detector signals to the lead 18. The threshold detector 26 has a detection level set during each frame to detect a high amplitude beacon signal which is then applied to the lead 28 and in turn to the latches 196 and 198. For determining the elevation position of the missile beacon relative to the detectors 14, the cyclic counter 52 responds to the clock 45 to apply binary count numbers from 0 to 34 through the composite lead 54 to the ROM (read only memory) 55 for developing a nonlinear code. The coded signals are then applied through the lead 57 to a buffer 204 which transfers each count to the latch 196. Upon the occurrence of a detected beacon signal on the lead 28, the code is stored in the latch 196 and applied through a composite lead 208 representing the elevation error signal $\epsilon_{EL}$.

The following table for each detector or clustered group of detectors shows the ROM 55 input values and shows the ROM output values or $\epsilon_{EL}$ for guiding the missile in elevation.

ROM 55 LOOK-UP TABLE

| DETECTOR NO. | CLUSTERED ROM INPUT VALUE | ROM OUTPUT (°EL) VALUE |
|---|---|---|
| 1 | 0 | −15 |
| 2 | 1 | −14 |
| 3 | 2 | −13 |
| 4 | 3 | −12 |
| . | . | . |
| . | . | . |
| . | . | . |
| 15 | 14 | −1 |
| 16 | 15 | 0 |
| 17 | 16 | +1 |
| 18 | 17 | +2 |
| . | . | . |
| . | . | . |
| . | . | . |
| 30 | 29 | +14 |
| 31 | 30 | +15 |
| 32 | 31 | +16 |
| 33 | ↑ | ↑ |
| 34 | 32 | +19 |
| 35 | \| | \| |
| 36 | ↓ | ↓ |
| 37 | ↑ | ↑ |
| . | \| | \| |
| . | 33 | +24 |
| . | \| | \| |
| 44 | ↓ | ↓ |
| 45 | ↑ | ↑ |
| . | \| | \| |
| . | 34 | +37 |
| . | \| | \| |
| 58 | \| | \| |
| 59 | \| | \| |
| 60 | ↓ | ↓ |

The ROM 55 look-up table for the detectors 1–32 receives an input count of 1–32 and provides an output on the lead 57 varying between −15 and +16 passing through 0 in response to the count of 15 from the cyclic counter 52 at which time the signal from the detector 16 is passed out of the multiplexer 16. For the single output from any of the detectors 33–36, during a single count period, the number 32 is provided by the cyclic counter 52 and the number +19 is applied to the buffer 204. The clustered output count for detectors 37–44 is the cyclic count 33 and the ROM 55 provides an elevation earror output value of +24. For the top of the field of view, the cyclic count for detectors 45–60 is 34 and the ROM 55 provides the value +37 to the buffer 204. When the missile beacon is near the top of the field of view, it is rapidly commanded toward the high resolution field of view by the weighted value +37 and is then commanded closer by the weighted value +24, and finally by the weighted value +19 into the high resolution or tracking field of view. Similarly, if the missile is at the elevation position of detectors 33–36, it is commanded by a weighted value +19 to a path near the elevation center of the reticle. The linear ROM output values in the high resolution field of view rapidly guide the missile in elevation to the reticle position of the detector 16.

For determining the azimuth missile tracking error, the azimuth position counter 150 which is an updown counter responds to the azimuth positon pickoff unit 48 to count from 0 to 255, as the mirror 80 (FIG. 2) scans in either direction, the field of view 161 being divided into 256 counts in the illustrated system. Each count is applied from the counter 150 through a composite lead 216 to a buffer circuit 218 coupled to the latch circuit 198. When a beacon signal is detected and applied to the lead 28, the azimuth count in the buffer 218 is stored in the latch 198 and applied through a composite lead 220 to a subtractor 224. A source 225 of a constant number 128 is connected to the subtractor 224 which provides positive and negative azimuth error signal $\epsilon_{EZ}$ to a lead 226 for being passed through a wire or transmitted to the missile guidance system. Thus, the error signals $\epsilon_{EL}$ and $\epsilon_{AZ}$ are generated and transferred to the missile 40 (FIG. 1) for guiding the missile in azimuth during the acquisition and tracking phases.

Referring now to the diagram of FIG. 8, a beacon display 240 is shown in the single field of view 161 with a line 242 representing 60 detectors being shown therein. A curve 244 is positioned in a graph with the left vertical axis showing 16 detectors above and below the beacon 240 which is at the center of the reticle in the tracking field of view and with the vertical axis on the right showing the error code. The error code value is also shown opposite stepped horizontal lines for the clustered detectors of groups of 4, 8 and 16 detectors. The elevation error signal $\epsilon_{EL}$ is shown on the vertical axis. The first 32 detectors as shown by the curve 244 provide a linear elevation error signal and the three groups of clustered detectors provide a nonlinear or an increasing and weighted slope at the top of the curve. A curve 246 illustrates the linearity of the azimuth error signal $\epsilon_{AZ}$ relative to the zero azimuth error of the beacon 240 shown at the reticle position of the high resolution field of view 160 (FIG. 7). The azimuth scan position in both directions is shown by the horizontal axis of the graph containing the curve 246. It is to be noted that within the scope of the invention, the azimuth error signal may be provided with a weighted or nonlinear variation such as by using a ROM as in the illustrated elevation error signal formation to provide weighting at both the left and the right of the field of view 161. Thus, the system of the invention operating with a single field of view, provides the high resolution tracking of a narrow field of view, while retaining the wide field of view 117 for missile acquisition. Although the illustrated system provided the high resolution portion of the field of view at the bottom thereof, it is be be understood that the scope of the invention includes having the high resolution portion at any desired elevation position of the single field of view.

Thus, there has been described a nonlinear tracking system which not only decreases the processing channels by clustering but provides nonlinear elevation tracking for the acquisition phase and high resolution linear tracking for the tracking phase. The system provides these features while utilizing only a single field of view, thus avoiding the undesirable characteristics of a two field of view system. Thus, the system of the invention not only provides a wide field of view but provides high resolution tracking, all with a single field of view.

What is claimed is:

1. A missile tracking system for developing tracking error signals for controlling said missile comprising:

scanning means for scanning in azimuth a field of view including a missile;

a line of a plurality of detectors positioned in elevation to receive energy from the scanned field of view, a selected first sequential number of said detectors receiving energy from a high resolution elevation tracking field of said field of view and a second number of sequential detectors receiving energy from a low resolution elevation field of said field of view;

a plurality of combining means each coupled to selected groups of said second number of detectors, each combining means having an output terminal;

multiplexing means coupled to the output terminals of each of said plurality of combining means and to said first number of detectors;

elevation error signal forming means coupled to said multiplexing means for providing first elevation error signals varying linearly as a function of detector position in response to said first number of detectors and for providing second elevation error signals varying nonlinearly as a function of the position of the groups of detectors coupled to each combining means; and azimuth error signal forming means coupled to said scanning means and to said multiplexing means for providing azimuth error signals.

2. The combination of claim 1 in which said second elevation error signals have weighted error values increasing with the elevation distance in said field of view from said high resolution field.

3. The combination of claim 2 in which said multiplexing means sequentially multiplexes signals from said first number of detectors and signals from said plurality of combining means during equal and continuous multiplexing periods.

4. The combination of claim 1 in which said missile includes a beacon signal and said elevation error signal forming means includes a cyclic counter coupled to said multiplexing means, a look-up table memory responsive to said cyclic counter, first latching means coupled to said look-up table memory and detecting means coupled to said multiplexer and to said first latching means for responding to a beacon signal and latching the output of said look-up table memory as the elevation error signal.

5. The combination of claim 4 in which said scanning means includes a source of azimuth synchronizing pulses and said azimuth error signal forming means includes a counter coupled to said source of azimuth synchronizing pulses for providing azimuth counts, second latching means coupled to said counter and to said detecting means for responding to a signal received from a beacon and latching the azimuth count, and subtracting means coupled to said second latching means for subtracting a selected value representing substantially the center of the field of view in azimuth from said azimuth count to provide said azimuth error signals.

6. The combination of claim 1 in which said scanning means includes a scanning mirror having a first side for transferring said field of view to said detectors and having a second side, and further including a line of a plurality of light emitting diodes coupled to said line of plurality of detectors for applying light representative of said field of view to the second side of said scanning mirror and includes viewing means for receiving the light reflected from the second side of said scanning mirror.

7. The combination of claim 1 in which each of said combining means is an "OR" gate.

8. A missile tracking system for responding to energy emitted from a missile for developing tracking error signals for controlling the path of said missile comprising:

scanning means for scanning in azimuth a field of view including a missile;

a column of a plurality of detectors positioned to receive energy in elevation as the field of view is scanned, each detector having an output channel;

a first group of said detectors corresponding to a high resolution portion of said field of view and a second group of said detectors corresponding to a low resolution elevation portion of said field of view;

a plurality of means for combining detector output channels, each coupled to a selected number of detectors of said second group to provide signals at an output terminal;

multiplexing means coupled to the output channels of said first group of detectors and to the output terminals of said means for combining;

elevation error means coupled to said multiplexing means for providing first elevation error signals in response to said first number of detectors and for providing second elevation error signals in response to said combining means, said first error signals varying linearly as a function of the position of said detectors in said high resolution portion of said field of view, said elevation error means including means so that second elevation error signals have values weighted for controlling said missile rapidly into said high resolution elevation portion of said field of view; and azimuth error means coupled to said scanning means and said multiplexing means for providing azimuth error signals.

9. The combination of claim 8 in which each of said plurality of means for combining detector output channels is an "OR" gate.

10. The combination of claim 8 in which said elevation error means provides said elevation error signals with weighted error values increasing with the elevation distance in said field of view from said high resolution tracking field.

* * * * *